US005323919A

United States Patent [19]

Ito et al.

[11] Patent Number: 5,323,919

[45] Date of Patent: Jun. 28, 1994

[54] BUTTON FEEDER FOR BUTTON APPLICATOR

[75] Inventors: Kazuyoshi Ito; Toshiaki Sodeno, both of Toyama, Japan

[73] Assignee: Yoshida Kogyo K.K., Tokyo, Japan

[21] Appl. No.: 996,309

[22] Filed: Dec. 23, 1992

[30] Foreign Application Priority Data

Dec. 25, 1991 [JP] Japan ..... 3-343164

[51] Int. Cl.[5] ..... A41H 37/10

[52] U.S. Cl. ..... 221/173; 227/119; 227/18

[58] Field of Search ..... 227/15, 18, 61, 62, 227/119; 221/123, 312 R, 171, 173; 29/811.2, 809

[56] References Cited

U.S. PATENT DOCUMENTS

| | | | |
|---|---|---|---|
| 2,265,574 | 12/1941 | Peterson | 227/119 |
| 2,588,486 | 3/1952 | Clarke . | |
| 4,019,666 | 12/1984 | Foults . | |
| 4,427,146 | 1/1984 | Seki | 227/119 |
| 4,569,470 | 2/1986 | Tanaka | 227/119 |
| 4,592,501 | 6/1986 | Sodeno et al. | 227/119 |
| 4,717,061 | 12/1988 | Seki | 227/119 |
| 5,031,815 | 7/1991 | Seki et al. | 227/119 |

FOREIGN PATENT DOCUMENTS

| | | |
|---|---|---|
| 0222543 | 5/1987 | European Pat. Off. . |
| 2856868 | 7/1980 | Fed. Rep. of Germany . |
| 2330343 | 6/1977 | France . |

*Primary Examiner*—Eugenia Jones
*Assistant Examiner*—Allan M. Schrock
*Attorney, Agent, or Firm*—Hill, Steadman & Simpson

[57] ABSTRACT

A button feeder for guiding and feeding a button element having an oriented pattern on its front face along a feed path and for insuring a desired orientation of the pattern. This button feeder provides a button pusher having a finger member projected from its frontal edge and urged resiliently downwardly from the pusher and the pusher provides a cam contactor projecting downwardly, the cam contactor riding on a cam surface, wherein the frontal edge of the pusher is guided and downwardly moved along the cam surface during transport and rotation of the button by the pusher along the feed path, and the finger member is lowered to engage a recess formed on the back face of the button head to arrest the rotation of the button element so as to orient and place a pattern on the button surface in a desired orientation.

11 Claims, 7 Drawing Sheets

BUTTON FEEDER FOR BUTTON APPLICATOR

BACKGROUND OF THE INVENTION

1. Field of the Invention

This invention relates to a button feeder for guiding a button element into a pocket disposed directly below a punch of a caulking unit, after being delivered from a chute to the button feeder in a button applicator, and more particularly to a button feeder for guiding and arranging the direction of surface pattern provided on the front face of the button element.

2. Description of the Prior Art

This kind of button feeders are disclosed in U.S. Pat. No. 5,031,815 and in Japanese Utility Model Publication No. H 3-12738 (1991).

The button feeder disclosed in U.S. Pat. No. 5,031,815 is composed of that a link pusher is rotatably attached to the tip of a swing lever pivoted to a frame and is reciprocated in a pusher guide trough defined in a button feed path to extrude and transfer a button element into a caulking unit of a button applicator. Then, a projecting portion is provided in the lower half part of the fore end of the pusher to place a part of the back face of the button element thereon and is always urged resiliently by means of a tension spring which is set between the swing lever and the pusher.

Further, the button feed path is defined in an unit composed of a metal square block and a web member having an L-shaped cross section. That is, a longitudinal trough is formed on the underside of the square block and has a wedge-shaped space for feeding the button body and a pusher guide trough. The wedge-shaped space is formed along the square block to contact the head surface of the button element with a receiving surface of the square block and to pinch a part of the front and back of the periphery of the button head. Further, a pressuring surface of the web member of the L-shaped cross section is disposed opposite to the receiving surface of the square block and is urged resiliently toward the receiving surface.

In this construction, when the button element having a tongue protruding from the rear face of the head is fed from the chute with its head surface facing downwardly into the button feed path of the feeder unit, a part of the button head is put on the projecting portion of the pusher, and at the same time, the pusher is advanced to extrude and transfer the button element. Then, since the head of the button element put in the wedge-shaped space has a larger slide resistance than the other part, the button element is transported while it rotates about its axis. This rotation is arrested as soon as the tongue of the button element is engaged in an engaging recess of the projecting portion of the pusher. Then, the button element is guided to the pocket of the caulking unit of the button applicator without rotation while the tongue is kept being engaged in the engaging element. Accordingly, the button element transported to the caulking unit is arranged in a desired direction to provide a desired orientation of the surface pattern.

The button feeder for the button applicator disclosed in Japanese Utility Model Publication No. H 3-12738 comprises a guide base, a pressuring member of a substantially L-shaped cross section being urged resiliently downwardly perpendicular to the guide base, a wedge member being set between a pressuring surface of the pressuring member and the guide base and having a slanted surface, and a side guide member of a substantially L-shaped cross section being disposed opposite to the pressuring member and the wedge member and being urged resiliently toward each of the above individual members. In this case, the button feed path is defined by these members.

Further, when the button element is passed through the button feed path, the head of the button element with a large diameter is pinched between the wedge member and the pressuring member. Therefore, as the button head is transported in the button feed path from the chute to the caulking unit, one side of the button element has a larger friction coefficient than the other side thereof. Accordingly, when the button element is extruded by the pusher, it is transported while it rotates about its axis. Then, a finger is moved together with the pusher and a downward projection of the finger is engaged in the recess formed on the back face of the button head to orient and place a desired direction of the button element.

However, with these button feeders, when a part of the button element is pressurized by the pressuring member, a portion of the button element put in the wedge-shaped groove is pushed by the slanted surface in the horizontal direction, and at the same time, the periphery of the button element put in the opposite groove is pinched resiliently between the upper and lower faces of the groove. Therefore, the button element can not be rotated smoothly due to reduced rotating force and thus can not be arranged in the desired direction surely as was expected.

Further, with the button feeder disclosed in U.S. Pat. No. 5,031,815, since the button feed path of the wedge-shaped cross section is formed directly in the square block, it is impossible to exchange the block with a new one. Furthermore, with the button feeder disclosed in Japanese Utility Model Publication No. H 3-12738, since the both pressuring member and side guide member are rotatably attached to the guide base by a pin, and at the same time, compression coil springs are set between the both members and the guide base, they can not be easily disassembled once they are assembled as the feed unit. As a result, the button feed unit is difficult to correspond with various button elements having a variety of diameters of heads. Accordingly, the button feeder can not be used widely for various buttons and button feed units as many as the number of the varieties of button elements are required if various button elements are used.

SUMMARY OF THE INVENTION

It is therefore an object of this invention to provide a button feed unit wherein a button element can be smoothly rotated and surely oriented in a desired direction.

Another object of this invention is to provide a button feed unit which can readily correspond with a variety of button elements, of which components can be easily exchanged for new components corresponding to button elements of various sizes.

Other objects of this invention will be apparent from the following description.

According to this invention, there is provided a button feeder for extruding and feeding a button element having a circular head provided with an orienting recess on a back face into a button applicator while orienting and placing it by means of a pusher having a finger member. Said button feeder comprises;

a swing lever of which a lower end is swingably pivoted to a frame, a link pusher for extruding the side of the button head by the frontal edge of the tip thereof urged resiliently downwardly, which is rotatably attached to the lower end of the swing lever, and which has a finger member projected from the frontal edge and urged resiliently downwardly and is provided with a cam contactor on the lower side thereof, and a button feed unit which is disposed between a button feed chute and a button caulking unit and which has a button feed path for rotating and feeding the button element while the surface of the button head is directed downwardly and a pusher passage for guiding the pusher, wherein the tip end of the cam contactor is resiliently contacted with a cam surface in the pusher passage.

In said button feed unit, the frontal edge of the pusher is guided and downwardly moved along the cam surface on the way of transporting the button element while the head side of the button element is extruded and rotated by means of the pusher. The finger member is engaged in the recess formed on the back face of the button head to arrest the rotation of the button element so as to orient and place a pattern on the button surface in a desired direction.

Favourably, the finger member has an engaging protrusion projected downwardly on the tip end, and the recess formed on the back face of the button element serves as means for engaging with the engaging protrusion of the finger member to orient and place the button element. The button feed path has a wedge-shaped space which pinches the front and back faces of the periphery of the button element and urges the button element in the center direction. Then, it is possible to exchange at least the button feed unit having the wedge-shape space in the button feeder.

In operation, while a button element is extruded along a feed path by a pusher, a part of the periphery of the button element is urged resiliently toward opposite guide base members and is pressurized in the wedge-shaped space of a back guide member from up and down.

Therefore, while the button element is pushed and transported by the pusher, the button element undergoes greater slide resistance at a part pressurized by the back guide member than at the other part in the feed path, so that the button element rotates smoothly about its vertical axis while it is transported along the feed path. Then, the downwardly directed protrusion of the tip end of the pusher is engaged in the recess formed on the back face of the button element to arrange the direction of surface pattern provided on the front face of the button element.

When button elements of different sizes will be transported along the feed path, since the button feed unit comprises a pair of opposite guide members, at least one detachable guide member having a wedge-shaped space must be replaced by new attachments for the different button elements.

DESCRIPTION OF THE PREFERRED EMBODIMENT

A preferred embodiment of this invention will be described with reference to the accompanying drawings.

Figure 7:
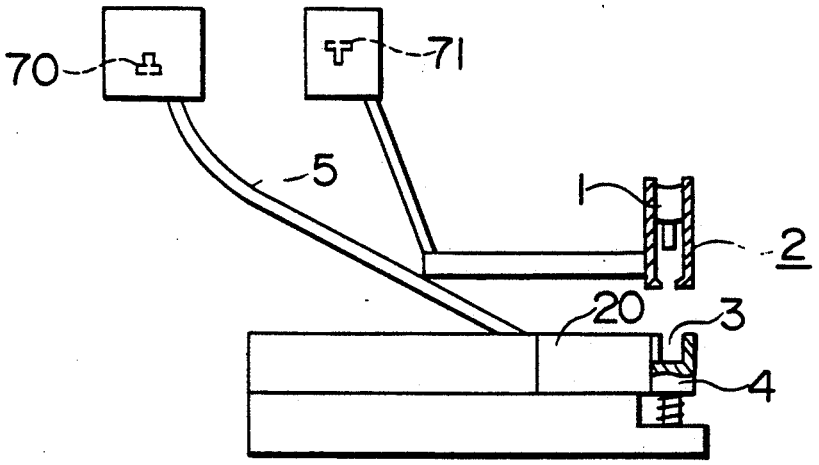
FIG. 7 is a perspective view showing an outline of a button applicator.

FIG. 7 shows an outline of a button applicator which is equipped with a button feed unit according to this invention. A button caulking unit of the applicator comprises a vertically movable caulking punch 1 which has a retainer 2 for gripping a rivet element 71 and a die 4 which is disposed below the retainer 2 and has a pocket 3 for setting a button element 70, wherein the rivet element 71 is caulked in the button element 70.

The button element 70 is fed from a hopper through a chute 5 and a button feeder 20 into the pocket 3. The button feeder 20 is disposed from an outlet location of the chute 5 to the location of the pocket 3. The button element is transported in the button feeder 20 while the side of the head is pushed by a pusher (not shown) which moves back and forth by means of a swing movement produced by a swing lever (not shown). Finally, the rivet element 71 is caulked through a garment in the button element 70 in operation of the punch 1 to assemble the both elements integrally.

FIG. 1 through FIG. 4 show a preferred embodiment of a button feeder of this invention. Since a tension spring 23 is set between the rear end of a pusher 22 and the middle part of a swing lever 21 as shown in these drawings, the end of the pusher 22 is always urged resiliently downwardly. A longitudinally extended recess **22*a* is formed on the upper face of the tip part of the pusher 22 and a cam contactor 22*b* is protruded from the lower face of tip part of the pusher. The cam contactor 22*b* is always contacted with the surface of a pusher passage in the button element feed unit according to this invention. The tip end of a plate finger member 24 is projected slightly from the tip of the pusher 22 and the plate finger member 24 is engaged to the pusher 22 within the recess 22*a*. The substantially central position of the finger member 24 is pivoted by a pin 25 to the substantially central position of the pusher 22. The finger member 24 corresponds to an engaging means according to this invention and is provided on the lower face of the tip with an engaging protrusion 24*a* which is engageable into an orienting recess 70*a* formed on the back face of the head of the button element 70. A compression coil spring 24*b* is set between the lower face of the rear end of the finger member 24 and the pusher 22, so that the tip of the finger member 24 is urged resiliently about the pin 25 in the clockwise direction in FIG. 1 and the engaging protrusion 24*a* is normally contacted with a frontal edge 22*c* of the pusher 22**.

Figure 5:
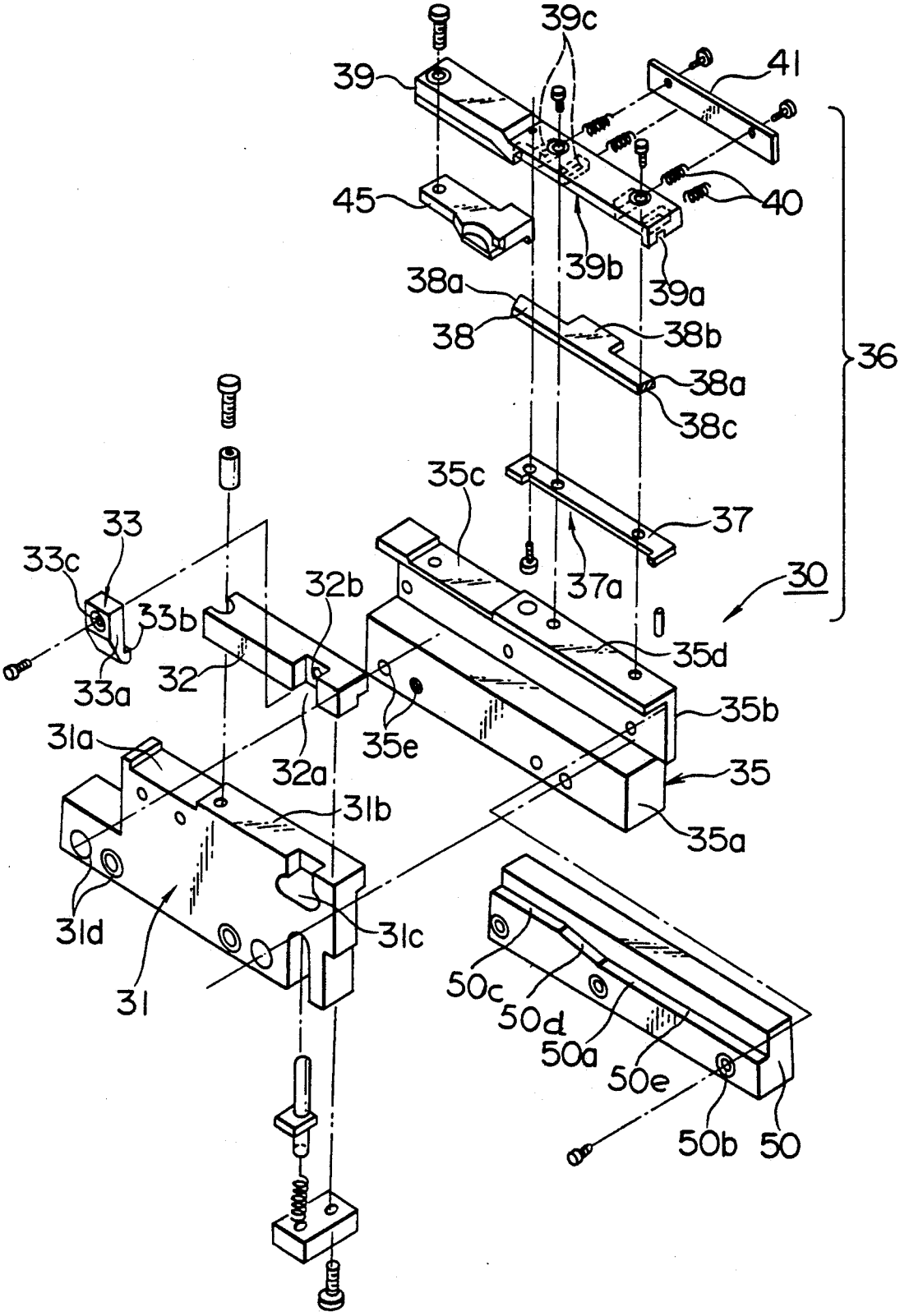
FIG. 5 is an exploded view of a button feed unit of this button feeder.

FIG. 5 is an exploded view which shows components of the feed unit 30 of this invention constituting a part of the button element feeder 20.

The button element feed unit 30 as shown in FIG. 5 comprises first and second front guide base members 31 and 35 which are respectively provided with guide faces 31*b* and 35*d* for guiding the front face of the button element 70, first and second back guide members 32 and 36 which are respectively disposed and fixed onto the guide members and also respectively provided with guide faces for guiding at least the periphery of the back face of the button element 70, and a pusher passage defining member 50 which is disposed and fixed between a pair of front guide base members 31 and 35 to define a pusher passage for extruding the circular head of the button element 70. The second back guide member 36 for the button element 70 is provided with an attachment 38 having a wedge-shaped space for pinching a part of the periphery of the button head from upside and downside and for resiliently urging the button element toward the other back guide member. The composition of the individual members will be illustrated in detail below.

The first front guide base member 31 is composed of a rectangular metal plate block machined to a desired shape, a recess 31*a* for leading the button element 70 fed from the chute 5 (in FIG. 4) being formed in one end of the upper face of the block, and a smooth guide face 31*b* for guiding the front side of the button element 70 being formed on the other portion of the upper face. The guide face 31*b* is provided with a grooved engaging portion 31*c* on a part of its outside, which is guided with a locking member 33 to combine the first back guide member 32 with the first front guide base member 31. Insertion holes 31*d* for plural bolts are drilled in the first front guide base member 31 to join the front guide base member 31 to the second front guide base member 35 by bolts. The detailed explanation of the other machined part is omitted herein.

The second front guide base member 35 is oppositely joined to the first front guide base member 31, and is provided with guide face defining member 35*b* of an L-shaped cross section which is stood along a side edge of the upper face of the square block 35*a* as shown in FIG. 5. A recess 35*c* for locking a positioning member 45 of the button element 70 is formed on the upper face of the guide face defining member 35*b* at the portion corresponding to the button element leading recess 31*a* of the first front guide base member 31. The other upper face of the guide defining member 35*b* is formed as a smooth guide face 35*d* for guiding the front side of the button element 70. A plurality of bolt holes 35*e* are drilled in the square block 35*a* to join the front guide base member 31. And a plurality of screwed holes are also formed in the guide face defining member 35*b* to lock the back guide member 36 and a pusher passage defining member 50.

Figure 3:
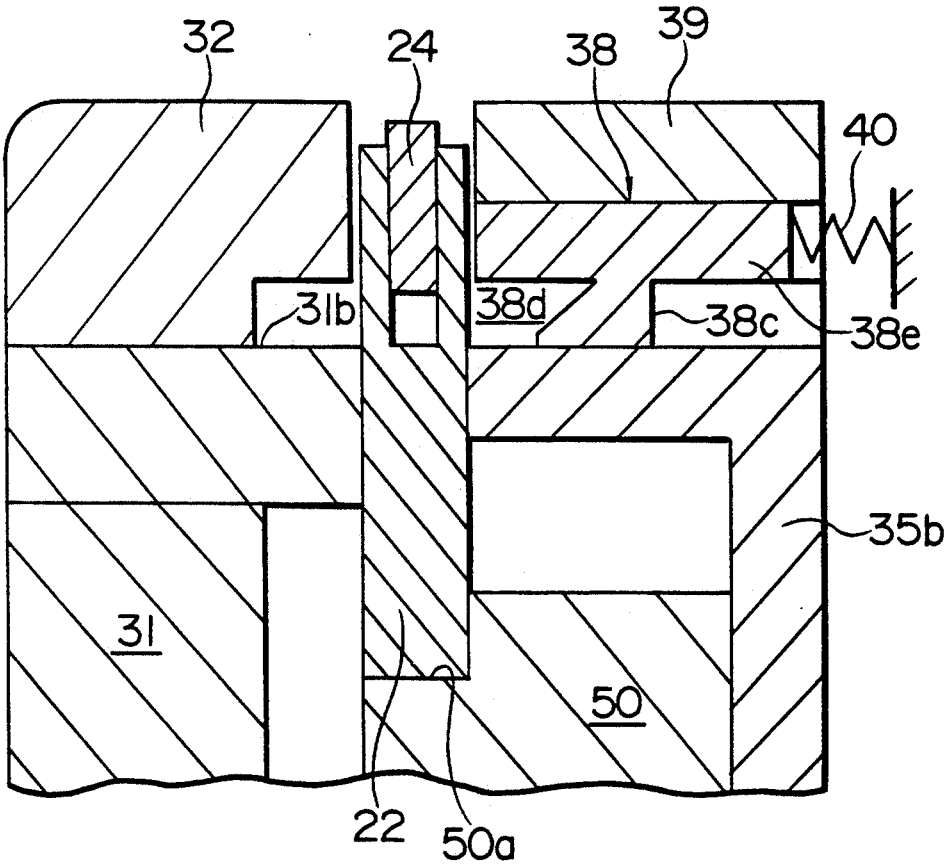
FIG. 3 is an enlarged sectional view of A—A line in FIG. 1.

The first back guide member 32 is put on and fixed to the guide face 31*b* of the first front guide base member 31. The first back guide member 32 comprises a square block of an L-shaped cross section as shown in FIGS. 3 and 5 and is provided with an engaging groove 32*a* for engaging with the locking member 33 at the portion corresponding to the engaging portion 31*c* of the front guide base member 31 and provided with a screwed hole 32*b* for locking the locking member 33 in the engaging groove 32*a*. The locking member 33 has an engaging protrusion 33*b* at one end of a body 33*a* as shown in FIG. 5. The body 33*a* is engaged with the engaging groove 32*a* of the first back guide member 32 and the engaging protrusion 33*b* is also engaged with the grooved engaging portion 31*c* of the first front guide base member 31. A bolt is inserted through a bolt insertion hole 33*c* formed in the body 33*a* into the screwed hole 32*b* of the back guide member 32 to join the both first front guide member 31 and first back guide member 32 integrally.

Figure 6:
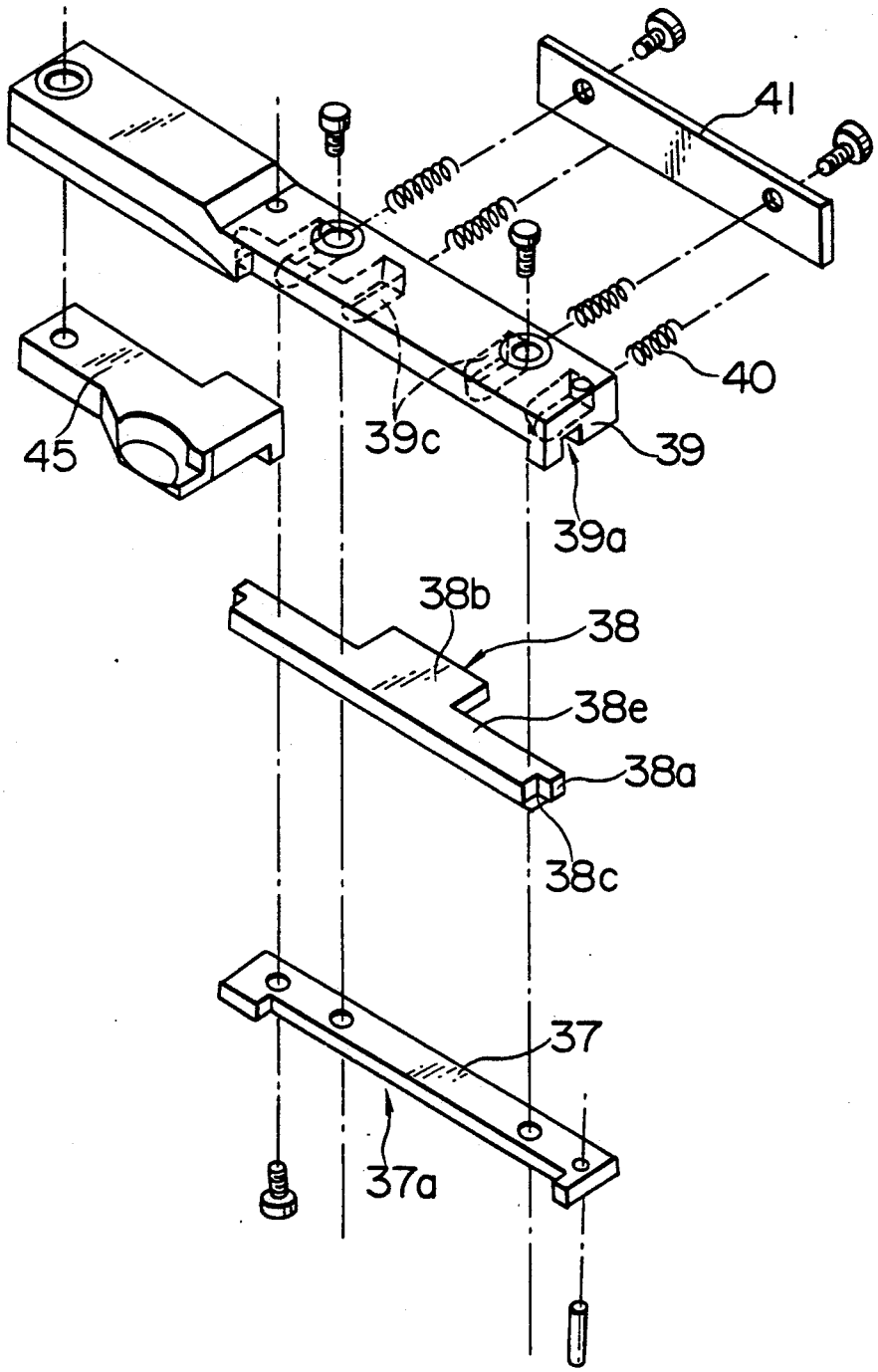
FIG. 6 is an enlarged and exploded view showing a back guide member of the button feed unit.

The second back guide member 36 is disposed opposite to the first back guide member 32 and comprises a plurality of attachments as shown in FIG. 6 presenting an enlarged and exploded view of the second back guide member. The second back guide member 36 as shown in FIG. 5 and FIG. 6 comprises a spacer 37 of a concave plate which is directly put and secured to the guide face 35*d* of the second front guide base member 35, an attachment 38 which is put on the spacer 37 and is engaged with a concave portion 37*a* of the spacer 37, a plate of attachment guide member 39 having the same length as the front guide base member 35, which is urged resiliently from the outside toward the attachment 38, the attachment 38 being slidably pinched between the spacer 37 and the guide member 39, and a regulating plate member 41 which is secured through compression coil springs 40 to the outside of the attachment guide member 39 to urge resiliently the back face of the attachment 38 by the compression coil springs 40 and to support the rear ends of the compression coil springs 40. These parts may be freely assembled and disassembled by bolts.

The attachment 38 is an important component of this invention and is composed of a plate of a substantially T-shaped cross section which is provided with the wide portion 38*b* as shown in FIG. 3 and FIG. 6. The attachment 38 has engaging protrusions 38*a* on longitudinal both ends and a portion 38*c* projected from the lower face along the whole length. The engaging protrusion 38*a* is engaged with an engaging groove 39*a* formed in the attachment guide member 39. The projected portion 38*c* has a downwardly inclined and tapered face inside to provide a pinching guide space 38*d* having a wedge-shaped cross section for pinching the button element 70 between the upper body 38*e* and the tapered face.

The attachment guide member 39 is provided with a recess 39*b* having the substantially same shape as the attachment 38 and engaging grooves 39*a* on the back face arranged opposite to the attachment 38. The attachment guide member 39 is also provided with plural concave grooves 39*c* formed in the recess 39*b* to mount the compression coil springs 40.

Figure 1:
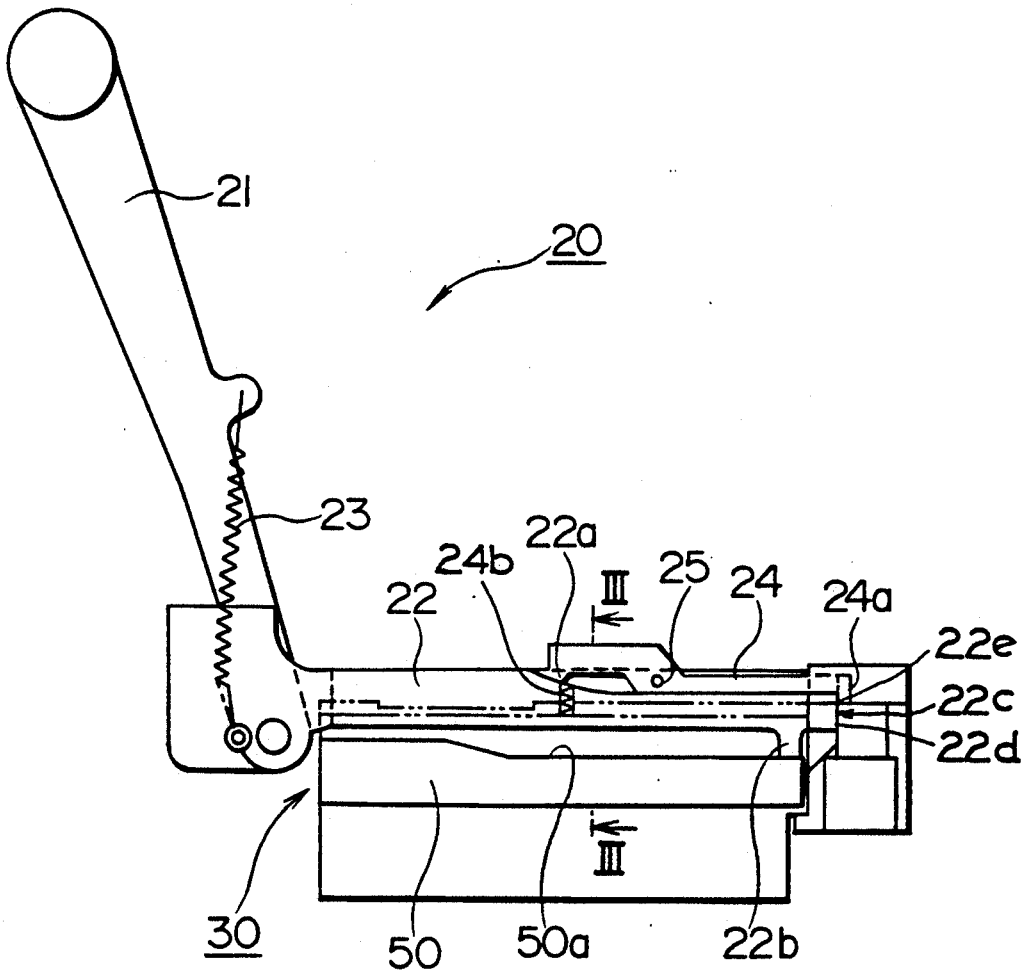
FIG. 1 is a vertical sectional view for a main part of a button feeder showing a typical embodiment of this invention.

The pusher passage defining member 50 comprises a square block as shown in FIG. 1 and FIG. 5, and is provided with a cam surface 50*a* formed in one side of the square block. The cam surface 50*a* is composed of an elevated horizontal face 50*c*, a downwardly inclined face 50*c* and a final horizontal face 50*e* which are arranged in order in the extruding direction of the pusher 22. The square block has a length equal to that of the first and second front guide members 31 and 35 and a width of the lower part equal to that of the square block 35*a* of the second front guide base member 35. The cam surface 50*a* has the width substantially equal to the thickness of the pusher 22. The width of the upper face of the pusher passage defining member 50 is equal to the width of the back face of the guide face defining member 35*b* of the second front guide base member 35. Plural insertion holes 50*b* for bolts are drilled in the pusher passage defining member 50, and screwed holes are also formed in the guide face defining member 35*b* of the second front guide base member 35, to join the both members 50 and 35 integrally by bolts. In this embodiment, the second front guide base member 35 and the pusher passage defining member 50 are individually formed, however the both members 35 and 50 may be formed together of one piece material.

Figure 4:
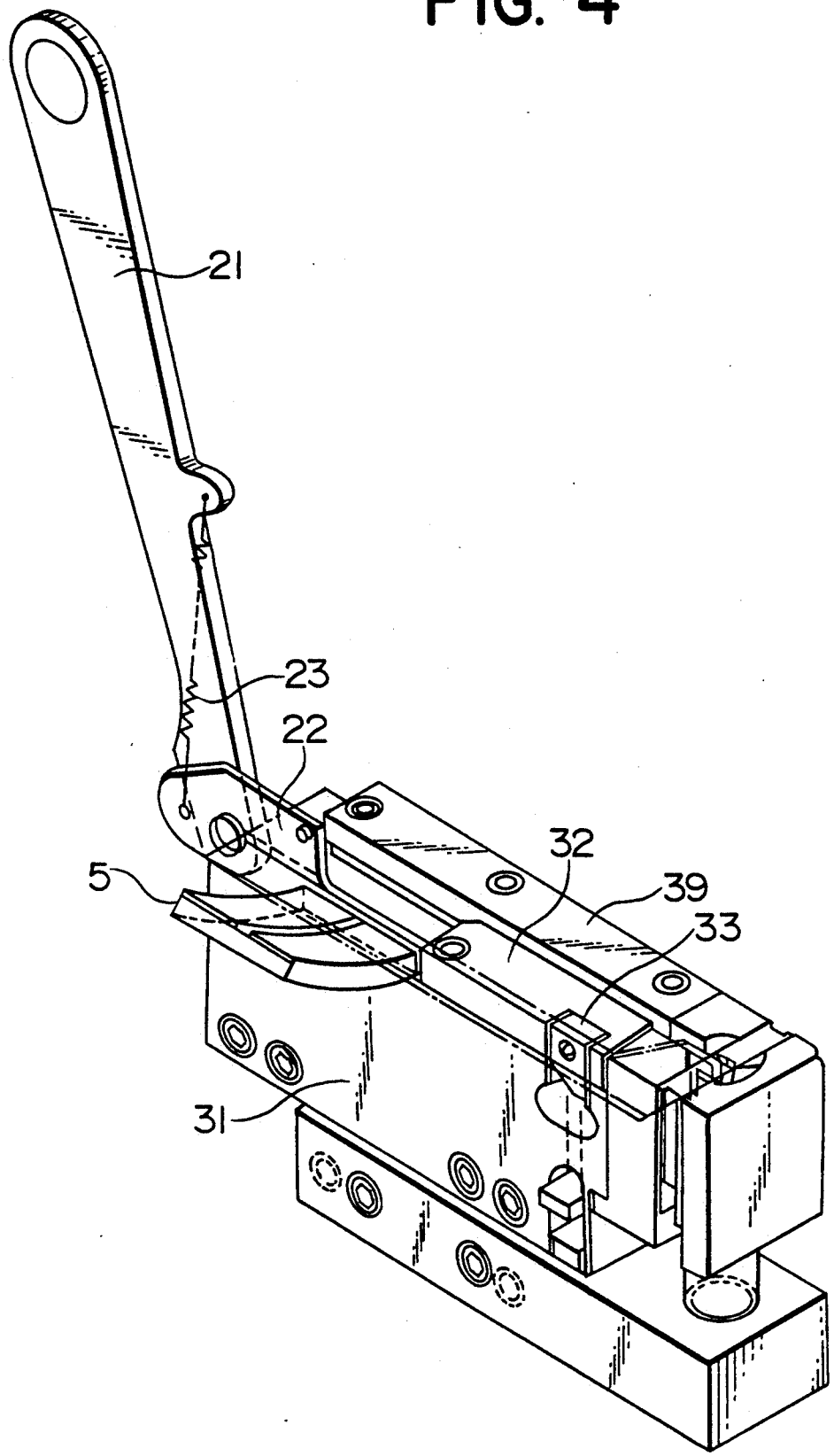
FIG. 4 is a perspective view showing the appearance of the main part of this button feeder.

FIG. 4 shows that the button element feed unit 30 assembled by the above-mentioned individual members is attached to the button applicator. An outlet of the feed chute 5 is disposed against the button element leading recess 31*a* of the first front guide base member 31. The pusher 22 is put in the pusher passage defined between the first and second front guide base members 31 and 35.

With the button element feeder according to this invention, the button element 70 fed from the chute 5 is transported at a downwardly faced position of the button head surface into the button feed path defined between the first and second front guide base members 31, 35 and the first and second back guide members 32, 36. Then, the pusher 22 is retracted to the left of FIG. 1 to the inlet of the pusher passage, and the tip of the cam contactor 22*b* rides resiliently onto the elevated horizontal face 50*c* of the pusher passage defining member 50. A lower half part 22*d* of the frontal edge 22*c* of the pusher 22 is contacted to the periphery of the button head of the button element 70 fed into the button feed path, and the engaging protrusion 24*a* of the finger member 24 is disposed above the back face of the button element 70.

Thereafter, when the swing lever 21 is swung and the pusher 22 proceeds along the pusher passage, the cam contactor 22*b* is resiliently guided along the cam surface 50*a* of the pusher passage defining member 50. When the cam contactor 22*b* reaches the final horizontal cam face 50*e* in the button feed direction, the pusher 22 has descended and is pushing the periphery of the button head by a central portion 22*e* of the frontal edge 22*c* thereof, and at the same time, the engaging protrusion 24*a* of the finger member 24 has lowered to resiliently press the back face of the button element 70 while the button element 70 rotates about its axis in the counterclockwise direction against the resilience.

Thus, while the button element 70 is fed through the feed path to the pocket 3 of the button applicator, a part of the front and back faces of the periphery of the button element 70 is urged resiliently in the direction orthogonal to the side face of the pusher 22 and pinched within the wedge-shaped space 38*d* of the attachment 38, so that the frictional resistance of the pinched front and back faces becomes larger than that of the other periphery to produce the rotational force about the vertical axis of the button element 70. Accordingly, when the button element 70 is transported by the pusher 22, it rotates about its vertical axis and proceeds along the feed path. Then, the engaging protrusion 24*a* of the finger member 24 protrudes from the frontal edge of the pusher 22 and is resiliently contacted with the back face of the button element 70, so that the engaging protrusion 24*a* is engaged with the engaging recess 70*a* of the back face of the button head to arrest the rotation of the button element 70. Therefore, the button element 70 is certainly transported at the desired orientation of the surface pattern to the pocket 3. According to this invention, since only a part of the head periphery of the button element 70 is pinched up and down by the wedge portion of the attachment 38 and the head periphery on the opposite side of the pinched portion is linearly contacted with the inside of the first back guide member 32 during rotation of the button element 70, the some frictional resistance is almost never produced on the opposite side to the pinched portion, the different friction forces causing rotation of the button element 70 considerably smoothly.

In this case, when the button element 70 is exchanged for the other button element of different size, first, locking screw parts are removed to separate the second back guide member 36 from the second front guide base member 31. Thereafter, the attachment 38 is detached from the second back guide member 36, and is exchanged for the other attachment for a new button element. Then, the new attachment is assembled in the second back guide member 36 and the second back guide member is combined with the second front guide base member 31. It is possible to exchange the first back guide member 32 by detaching the locking member 33 if necessary. And moreover it is possible to exchange the second back guide member 36 including the attachment 38 as an unit.

Figure 2:
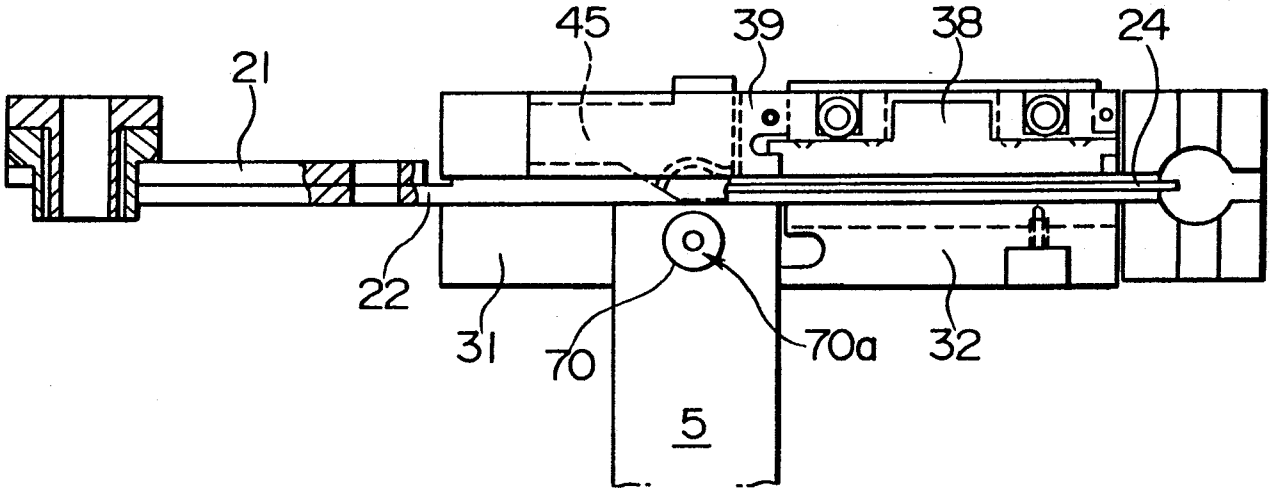
FIG. 2 is a top plan view showing the main part of this button feeder.

In FIG. 1 to FIG. 3, the engaging recess 70*a* engaged with the engaging protrusion 24*a* of the finger member 24 is shown as a favourable example of the engaging portion of the button element 70, however the tongue-shaped engaging portion may be of course adopted as the engaging means.

As stated clearly hereinabove, according to this invention, a button feeder is characterized by that a pusher is reciprocated in a pusher passage within the button feed unit by a swing lever, and in spite of opening of the upper part of the pusher passage, the tip of the pusher is always urged downwardly and is resiliently contacted on the cam surface during reciprocation of the pusher. Since the engaging protrusion projected from the frontal edge of the pusher is always urged downwardly, the engaging protrusion is resiliently contacted with the back face of the button head certainly. When the button element is also transported along the button feed path within the feed unit while it rotates about its vertical axis, the engaging portion of the tip of the pusher is certainly engaged with the engaging recess formed on the back face of the button element. Therefore, it is possible to arrest the rotation of the button element with the surface pattern of the button element at the desired orientation.

Furthermore, in accordance with this invention, since components for constituting at least a button feed path in the button feeder can be detached from the button feeder, when the button elements of different sizes are used in this feeder, this button feeder can readily and immediately correspond with new button elements by exchanging the components only. Therefore, this button feeder can be broadly used for feeding a variety of button elements.

While a preferred embodiment of this invention have been described using specific terms, such description is for illustrative purpose only, and it is to be understood that changes and variations may be made without departing from the spirit or scope of the following claims.

What is claimed is:

1. A button feeder for translating and feeding a button element having a circular head having front and back faces and provided with an engaging recess on the back face thereof into a button applicator while orienting and placing, said button element comprising:

a swing lever of which a lower end is swingably pivoted with respect to a frame;

a link pusher for translating the button head by a frontal edge of the pusher, said pusher being urged resiliently downwardly, and pivotally attached to the lower end of said swing lever, wherein said pusher has a finger member projecting from the frontal edge which is urged resiliently downwardly, and said pusher has a cam contacting portion; and a button feed unit having a button feed path for rotating and feeding said button element while the button head front face is directed downwardly and a pusher passage for guiding said pusher, said cam contacting portion resiliently contacting a cam surface of varying elevations in said pusher passage;

wherein the frontal edge of said pusher is guided and moved downwardly as said cam contacting portion is translated along said cam surface pushing said button element along said button feed path while said button element is translated and rotated by said pusher, and said finger member is engaged in the recess formed on the back face of said button head to arrest the rotation of said button element so as to orient and place a pattern on the button element in a desired direction.

2. A button feeder according to claim 1, wherein said finger member has an engaging protrusion projected downwardly on the tip end thereof.

3. A button feeder according to claim 2, wherein the recess formed on the back face of said button element engages said engaging protrusion of said finger member to orient and place said button element.

4. A button feeder according to claim 3, wherein said button feed path has a wedge-shaped space which pinches a part of the front and back faces of the periphery of said button element and urges said button element in a direction perpendicular to said button feed path.

5. A button feeder according to claim 2, wherein said button feed path has a wedge-shaped space which pinches a part of the front and back face of the periphery of said button element and urges said button element in a direction perpendicular to said button feed path.

6. A button feeder according to claim 1, wherein said button feed path has a wedge-shaped space which pinches a part of the front and back faces of the periphery of said button element and urges said button element in a direction orthogonal to said button feed path.

7. A button feeder for translation a button element from a button feed chute and feeding the button element to a button caulking unit, the button element having a circular head having front and back faces and provided with an engaging recess on the back face and orienting the button element for application in the caulking unit, said button feeder comprising:

a button feed unit having a button feed path having an inlet for receiving said button element from said button feed chute and an outlet for feeding said button element into said button caulking unit, and means along the button feed path for causing axial rotation of said button element translating therethrough with a head portion oriented with its front face facing downwardly, and a pusher passage arranged along the button feed path, a cam surface arranged along the pusher passage;

a pusher arranged to reciprocate within said pusher passage, said pusher having a surface portion for abutting a trailing end of said button element placed within the button feed path, and a cam contacter operatively connected to said surface portion and resiliently urged downwardly against said cam surface, said pusher having a finger member projecting forwardly from the surface portion and connected to said surface portion, said finger member shaped to engage the recess formed on the back face of said button head; and wherein said cam surface comprises an elevated region and a lower region adjacent said caulking unit, and wherein said elevated region causes said cam contactor to elevate said finger member above the back face of the button head and said lower region allows said finger member to descend onto said back face of said button head during translation of said pusher along said pusher passage.

8. A button feeder according to claim 7 further comprising:

a stationary frame; and a swing lever of which a lower end is swingably pivoted with respect to said frame; and said pusher is rotatably attached to the lower end of said swing lever, and said cam contactor is urged downwardly with respect thereto.

9. A button feeder according to claim 7, wherein said pusher comprises an elongate slider and said finger member comprises a lever mounted pivotably at a central portion of said slider and biased by a spring member on a proximal end thereof and having a finger protrusion at a distal end thereof urged by said spring member downwardly, said finger protrusion extending outwardly of said slider.

10. A button feeder according to claim 7, wherein said means for causing axial rotation comprises opposite lateral guideplates along the button feed path, at least one of said guideplates comprising a wedge-shaped space for pinching a part of the periphery of a button head being guided thereby, said at least one guideplate urged in a direction perpendicular to the button feed path.

11. A button feeder according to claim 7, wherein said finger member is connected to said pusher resiliently, to allow a vertical movement between said surface portion and said finger member allowing said finger member to resiliently press onto said back face of said button head during translation of said pusher along said pusher passage.

* * * * *